United States Patent [19]

Chalmers

[11] Patent Number: 4,654,985

[45] Date of Patent: Apr. 7, 1987

[54] ATHLETIC BOOT

[76] Inventor: Edward L. Chalmers, 4907 Clubhouse Cir., Boulder, Colo. 80301

[21] Appl. No.: 686,148

[22] Filed: Dec. 26, 1984

[51] Int. Cl.[4] ..... A43B 11/00; A43B 5/04

[52] U.S. Cl. ..... 36/50; 36/115; 36/117; 24/68 SK

[58] Field of Search ..... 36/117–121, 36/50, 115, 83; 24/68 SK, 69 SK, 70 SK, 71 SK

[56] References Cited

U.S. PATENT DOCUMENTS

| | | | |
|---|---|---|---|
| D. 205,993 | 10/1966 | Ali | 36/117 X |
| 4,408,403 | 10/1983 | Martin | 36/117 X |

FOREIGN PATENT DOCUMENTS

| | | | |
|---|---|---|---|
| 0114209 | 8/1984 | European Pat. Off. | 36/83 |
| 3342331 | 5/1984 | Fed. Rep. of Germany | 36/117 |
| 3247516 | 6/1984 | Fed. Rep. of Germany | 36/117 |
| 2399811 | 3/1979 | France | 36/119 |

*Primary Examiner*—James Kee Chi

*Attorney, Agent, or Firm*—Fitzpatrick, Cella, Harper & Scinto

[57] ABSTRACT

A closure mechanism for overlapping closure flaps of an athletic boot comprises at least one cable arranged to overlap the flaps and travel interiorly of the boot to a position remote from the overlapping flaps. The cable then exits the interior of the boot and is connected to a latch for pulling the end of the cable to draw it about and close the overlapping flaps.

19 Claims, 12 Drawing Figures

ATHLETIC BOOT

BACKGROUND OF THE INVENTION

The present invention relates generally to athletic boots and more particularly to a closure mechanism for athletic boots such as ski boots.

With the advent of substantially rigid molded plastic shells for ski boots and the like, the means for comfortably but securely closing the shell about the wearer's foot has been of considerable importance. Heretofore, ski boots in particular have been provided in two general designs fitting the forefoot in different ways. According to one design, commonly referred to as front-entry boots, overlapping flaps are provided which, being flexible to some extent, fold over the forefoot to encase it. In the second design, a relatively unyielding shell of fixed shape surrounds the forefoot. In this design, the fit is accomplished internally and a closure is provided at the rear of the boot. Such boots are commonly referred to as rear-entry boots.

Overlapping-flap boots are the most common type of ski boot. Such boots are often constructed in two pieces with the upper pivotally connected to the lower at about the ankle region. There are, however, so-called three-piece ski boots, which have, in addition to the upper and lower, a front tongue exterior to the shell covering an opening in the top of the boot from the toe area to the area of the shin. In a rear-entry boot, the rear portion of the shaft surrounding the lower leg can be considered to be a combination of overlapping flaps in the manner of a three-piece boot's lower. The principle of closure is the same.

Early boots were closed with laces which applied a rather uniform pressure on the foot, but were time consuming to close, difficult to tighten and difficult to adjust while skiing.

Later, buckles such as are disclosed in my U.S. Pat. No. 4,051,611, were applied to the overlapping flaps providing a faster and more adjustable closure system. These devices can apply higher forces to more easily close modern, relatively stiff, plastic ski boots. Buckles are also the most common means of closing rear-entry type boots about the lower leg, differing only from the front-entry design in position of the catches and latches on the shell.

In conventional overlapping front-entry boots, at least one buckle is provided for closing the upper portion about the shin area. Best adjustment of the lower over the fore-foot is provided by two buckles, one near the front end of the metatarsals and one in the region of the instep. Two buckles accommodate the great differences in slope and size of the insteps of individual feet and allow for different degrees of tightness at these areas. While a single buckle closure lever would be more desirable, it is difficult to design one mechanism in the limited space presented on the side of the boot shell which still keeps the adjustment and independent action desired. Thus, one drawback to existing closure systems employing two or more buckles is that each latch must be individually connected to and disconnected from a catch every time the boot is put on and taken off.

The known ski boot buckle systems are also disadvantageous in that they prevent a sleek appearance to the boot. Buckles also tend to catch on other objects while walking or skiing, for example door frames, ski-racing poles, etc, and they cause added wind resistance, a disadvantage in downhill ski-racing or speed trials.

In addition, the major disadvantage of the known buckle systems is that they apply forces to the ski boot shell mainly in the localized area of their attachment. The buckles must be attached to the shell in relatively specific locations. If they are too far around the inside half, they interfere with the other boot and ski edges. If too far down on the outside, they hit the snow during skiing or the floor or other objects when walking. As a result, when closed, the catch component and latch component each create, at the points of respective attachment to the shell, radial and tangential components of force and moments. All of the closing forces and moments are concentrated in localized regions of the shell resulting in localized downward pressure on the foot and a tendency to distort the shell into the foot.

The elastic nature of materials used in, e.g. ski boot shell construction, distributes the forces acting on the shell through the lining of the boot to the wearer's foot. Although a tongue is normally positioned over the top of the foot it does not dissipate the highest forces because it must itself be relatively flexible to accommodate the large varieties of foot shapes and amounts of closure of the boot that occur depending on foot shape. Unfortunately, the highest forces are applied to the foot in or near two of the most sensitive areas of the foot, the top of the instep and the side of the foot forward of the outside ankle, causing pain and numbness. The pressures also restrict blood flow causing cold feet in skiing and a tendency to cramp.

Another disadvantage to the known buckle systems is that the forces are applied to the shell at only two points, that is, the position of the catch and the position of the latch. Internal stress in the shell increases from zero at the point of load application to its highest where the sidewall attaches to the sole section of the boot. Therefore, it has been necessary to construct the boot shells with thicker wall sections at the areas of high stress and fatigue. Construction of plastic boot shells in such manner, however, requires molds which are difficult to make and are, thus, costly. It would be much easier and less costly to make a shell with uniform wall thickness. Shells with heavy wall thickness also increases the amount of expensive plastic shell material and increases the weight of the boot, both of which are undesirable. It also requires that the shell be made by the relatively costly method of injection molding rather than a less expensive way, for example, by blow molding which is better suited to articles of relatively uniform wall thickness.

Thus, it is desirable to eliminate conventional buckles from the sides of athletic boots and particularly ski boots. To some extent the aforementioned disadvantages have been eliminated by the so-called rear-entry boots where the closure mechanism is situated at the rear of the boot. In these designs, the foot is held inside a rigid outer shell of fixed shape by an internal fitting system or mechanism such as is disclosed in U.S. Pat. No. 4,160,332. Although such designs provide greater convenience, styling opportunities and comfort, they do not hold the foot and lower leg as well as overlapping flap boots and consequently do not ski as well. Furthermore, the internal fitting mechanisms of present rear-entry boots are unable to provide optimum close fit, usually because they act on a relatively small area of the foot and cannot encase the entire foot.

In another approach to eliminate the pressure concentration of buckle systems, a ski boot is known which has buckles attached to stainless steel straps surrounding the forefoot in the traditional buckle locations. These straps still do not eliminate the radial components of force and the moments about the connections that cause comfort problems. Rather the extra width of the strap where the latch and catch are attached only serves to spread the load from the buckle over a slightly wider area.

Accordingly, it is an object of the present invention to provide a closure system for athletic boots and particularly ski boots which allows greater comfort and convenience, streamlining, reduced weight and cost, and improved styling possibilities, while retaining the fit and performance inherent in the design of front-entry boots.

It is another object to provide a closure system for ski boots and other footwear which applies closing forces perpendicularly to the boot shell at any point around the foot rather than tangentially whereby a more uniform pressure distribution is applied to the wearer's foot.

SUMMARY OF THE INVENTION

In accordance with the present invention, the disadvantages of the prior art are avoided by means of a wrap-around, flexible, tensilely strong and relatively inelastic, cable closing system for an athletic boot, particularly the outer shell of a molded ski boot. The closing system applies a uniform radial force pattern to the shell resulting in a more comfortable fit and the elimination of the pressure concentrating force components and moments of conventional buckles.

The present invention also comprises an improvement over the prior art in that the latch mechanism used to close the wrap-around closure is positioned so that the downward components of closing force which occur with conventional buckles is avoided. Also, the closure of the lower at the important areas near the toe and the instep regions can be combined into one latch for more convenient operation. Since both ends of the flexible cable surrounding the part to be closed are attached to a single latch lever, the required throw of the latch lever to tighten the shell is reduced by one half over that required in the prior art buckle systems. For example, if the boot must open by 4 inches to get the foot in and out, pulling 2 inches on each end of the cable is all that is required to pull the boot tight. This can be accomplished by an overthrowing lever with a throw of only one inch making the entire mechanism a manageable size for a location such as of the rear of the boot.

The present invention further comprises an improvement over the prior art in that the closure system permits for the construction of athletic boots and particularly ski boots with thinner uniform wall sections. Because the stress in the shell from a uniformly applied force is lower than the stress from a point load of a normal buckle system, less wall thickness is required to resist that stress and fatigue. This results in the added benefit that the force required to retain the foot in the boot is lower because thinner walls of the lower shell need less force to close them about the foot. Thus less pressure is required around the foot to hold it. Moreover, because thinner wall sections bend more easily, the boot is easier to open and thus easier to enter and exit than traditional designs. Additionally, boots using thinner walls use less plastic in the shell resulting in a cost savings. Boots so constructed will weigh less than traditional boots making them easier to carry and walk in. As a further advantage, shells having more uniform wall thickness, as is permitted by the present invention, makes it possible to manufacture the shells by less costly methods.

According to one aspect of the present invention, there is provided a closure mechanism for an athletic boot having overlapping closure flaps which comprises, in its simplest form, at least one flexible cable arranged exteriorly over said flaps, means directing said cable interiorly of said boot whereby said cable substantially forms a loop encompassing said overlapping flaps, means directing said cable interiorly of said boot to a position remote from said overlapping flaps, means directing said cable exteriorly of said boot at said remote position and latch means secured to the exterior of said boot and engaging the ends of said cable, said latch being adapted to pull said cable to draw said loop and close said overlapping flaps.

According to another aspect of the present invention, there is provided a latch mechanism for closing a member adapted to close overlapping flaps of an athletic boot which comprises a first lever pivotally connected to a stand adapted for mounting to said boot, a second lever having a pair of spaced parallel arms pivotally connected to said first lever for rotation about an axis parallel to the axis of rotation of said first lever, a third member having a pair of spaced parallel arms pivotally connected to said second lever for rotation about an axis parallel to the axes of rotation of said first and second levers and means connecting said third member to said closure member for closing said overlapping flaps upon rotation of said first and second levers.

There has thus been outlined, rather broady, the more important features of the invention in order that the detailed description thereof that follows may be better understood and in order that the present contribution to the art may be better appreciated. There are, of course, additional features of the invention which will be described hereinafter and which will form the subject of the claims appended hereto. Those skilled in the art will appreciate that this invention may be utilized as a basis for designing other structures for carrying out the several purposes of this invention. It is therfore important that the claims be regarded as including such equivalent constructions as do not depart from the spirit and scope of the invention.

BRIEF DESCRIPTION OF THE DRAWINGS

Several embodiments of the invention have been chosen for purposes of illustration and description, as shown in the accompanying drawings forming a part of the specification, wherein.

DETAILED DESCRIPTION OF THE INVENTION

Figure 1:
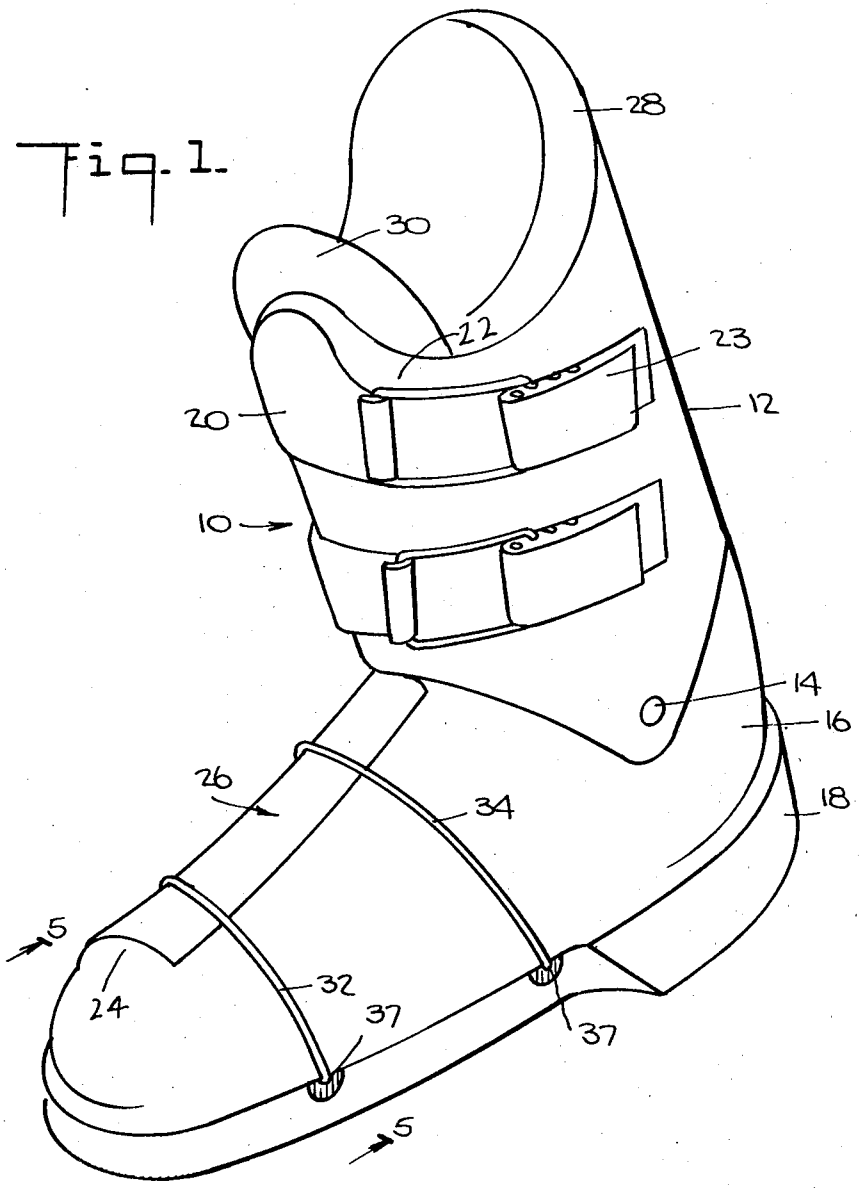
FIG. 1 is a perspective view of a molded ski boot incorporating the closure system of the present invention.

The closure system according to the present invention is particularly useful in association with a synthetic molded ski boot, such as shown in FIG. 1, and generally indicated by the reference numeral 10. In the embodiment shown, the closure system is illustrated as applied to the overlapping flaps of the lower of a two piece front entry boot. However, it will be appreciated that the present invention may be used for closing any overlapping closure flaps of an athletic boot irrespective of the area of closure. Furthermore, although the present invention is illustrated utilizing two cables described hereinafter, it should be understood that a single cable may be used for certain types of boots and particularly for children's boots. In like manner, more than two cables may be utilized as will be apparent to those skilled in the art. The boot illustrated in FIG. 1 comprises an upper outer shell 12 pivotally mounted by rivets 14 to a lower shell 16 and a sole 18. The upper 12 and lower 16 are each formed with a pair of opposed closure flaps 20, 22 and 24, 26 respectively for permitting entry and exit of the foot. Positioned within the upper 12 and lower 16 are a padded inner boot 28 and tongue 30. In the embodiment shown, the upper closure flaps 20 and 22 are closed and secured together by known buckles generally indicated by the reference numeral 23, such as are disclosed in U.S. Pat. No. 4,051,611.

Figure 2:
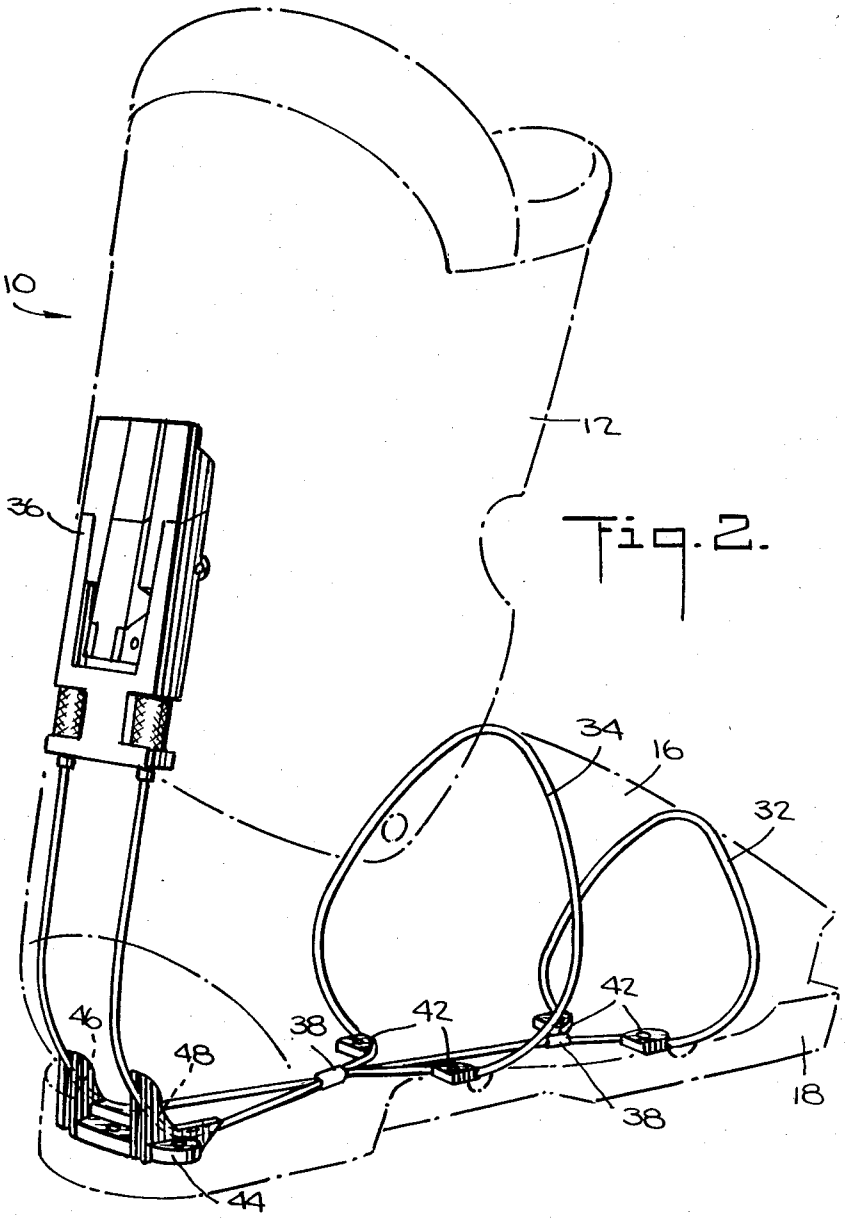
FIG. 2 is a view of the closure system with the boot shell shown in phantom.

For closing and securing flaps 24 and 26 of lower 16, a pair of cables 32, 34 are provided which are positioned at approximately the instep region and area just forward of the toes, respectively. Briefly, cables 32 and 34 each wrap over the closure flaps 24, 26 and lower shell 16 and are then threaded into a cavity 40 within the sole 18, where they are each joined to themselves and extend rearwardly to exit the shell at the heel area above the sole 18. After exit from the sole 18, cables 32, 34 extend upwardly to a latch generally indicated by the numeral 36 as shown in FIG. 2. Latch 36 is a lever type which, when open, loosens cables 32 and 34 permitting entry into the boot and, when closed, draws cables 32 and 34 to close and secure flaps 24 and 26 about the foot. In the embodiment shown, one end respectively of cables 32 and 34 is joined to the cable to form a loop with the other end being connected to the latch 36. However, the present invention also contemplates cables which are not joined interiorly of the boot, but have both ends connected to the latch 36 with a loop beng formed by appropriate guides within the cavity 40. This would be particularly applicable in a situation where only one cable is employed and both ends are connected to the latch mechanism which accomplishes the same degree of drawing action as in the embodiment shown.

Cables 32 and 34 may be constructed of any flexible high tensile material and although cables are illustrated, synthetic straps are equally applicable. However, it is presently preferred to utilize 1/16" diameter cables constructed of woven galvanized or stainless steel wire.

It is desirable that the cables 32, 34 enter and exit the shell and sole walls with the cable in a direction perpendicular to the shell as much as possible to prevent compression set of the plastic and resulting hole enlargement. Although the cables may be threaded through the shell merely by providing holes therein, it is preferred to utilize sealing plugs, as will be described further hereinafter.

In FIGS. 3 through 7, the arrangement of the closure cables 32 and 34 is shown in greater detail. Exteriorly of the boot, cables 32, 34 each circumferentially overlap flaps 24, 26 and shell 16 to a point at which they are threaded through ports 37 formed at the point of juncture of sole 18 and lower 16. Within cavity 40 formed in sole 18, cables 32 and 34 are guided rearwardly by quarter rounds 42 and then separately joined by clamps 38 to form forward loops encompassing the overlapping flaps 24, 26. Cables 32, 34 thereupon extend rearwardly through cavity 40 to guide 44 having curved channels 46, 48 through which cables 32, 34 are guided to exit ports 52 provided in the rear of shell 16 slightly above the junction of shell 16 and sole 18. Preferably, guide 44 is constructed as a unitary piece of hard glass-filled plastic which is embedded in the sole 18 during molding of the shell. To avoid any potential interference with a safety ski binding mechanism, not shown, exit ports 52 should be at least ¼" above the rear extension of the boot sole 18. After exit from the boot shell 16, cables 32, 34 extend upwardly to latch 36 mounted, in the embodiment shown, to the rear of the boot upper 12. The particular type of latch 36 employed is not critical to the present invention as long as it has a throw which pulls and slackens the cable ends to permit closure and opening of opposed flaps 24, 26. It is only necessary for the latch to have a throw of in the order of one inch which, when closed, will pull the ends of cables 32, 34 by two inches effecting a total shortening of each cable of four inches. In like manner, opening the latch will permit extension of the cables by a total amount of four inches which is enough to allow the foot to exit.

Figure 3:
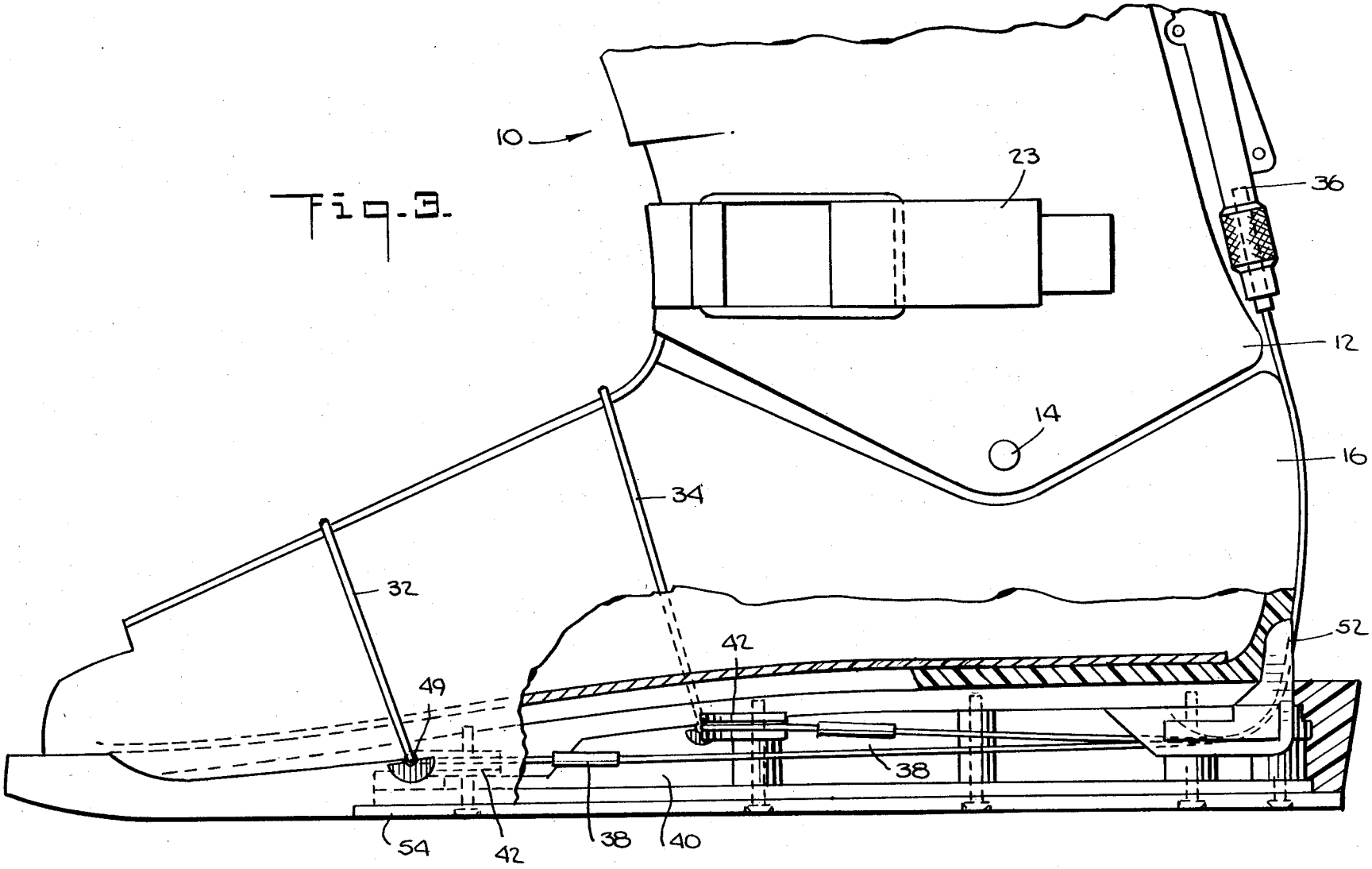
FIG. 3 is a side view the boot of FIG. 1 partially in section.

As will be apparent from FIG. 3, the closure force exerted by cable 32, is radially and uniformly applied at all points perpendicular to the shell 16, inner boot 28 and tongue 30. Thus, the closure cables 32, 34 do not result in localized forces being applied to the foot of the wearer. Furthermore, as shown in FIG. 3, the present invention permits maintenance of uniform wall thickness of the side walls of shell 16 until joinder thereof to the sole 18. In addition to permitting a constant wall thickness, the side walls are only required to be of such thickness as to dissipate the load from the travel of cables 32 and 34.

Figure 4:
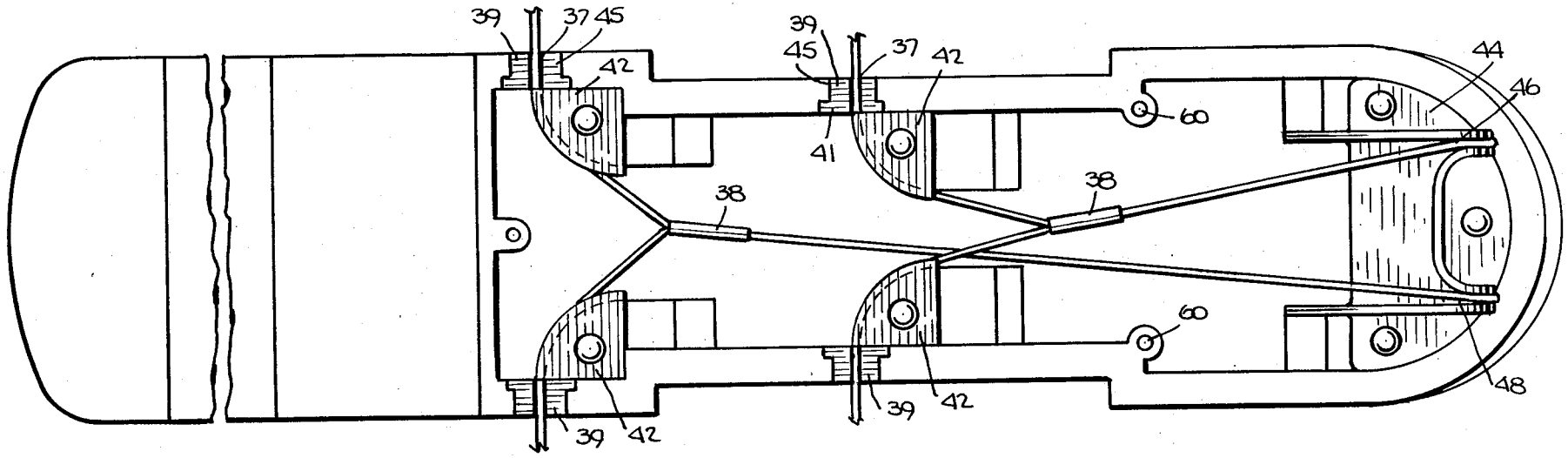
FIG. 4 is a bottom plan view of the boot of FIG. 1, with the sole plate removed.
Figure 5:
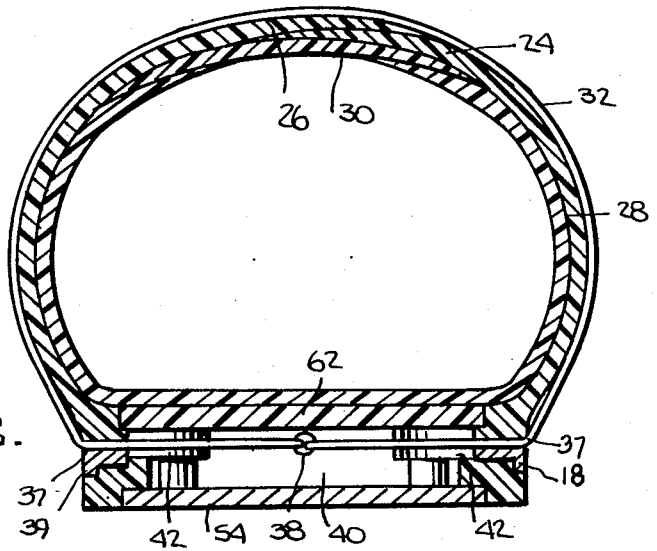
FIG. 5 is a cross-sectional view taken along lines 5—5 of FIG. 1.
Figures 7, 12:
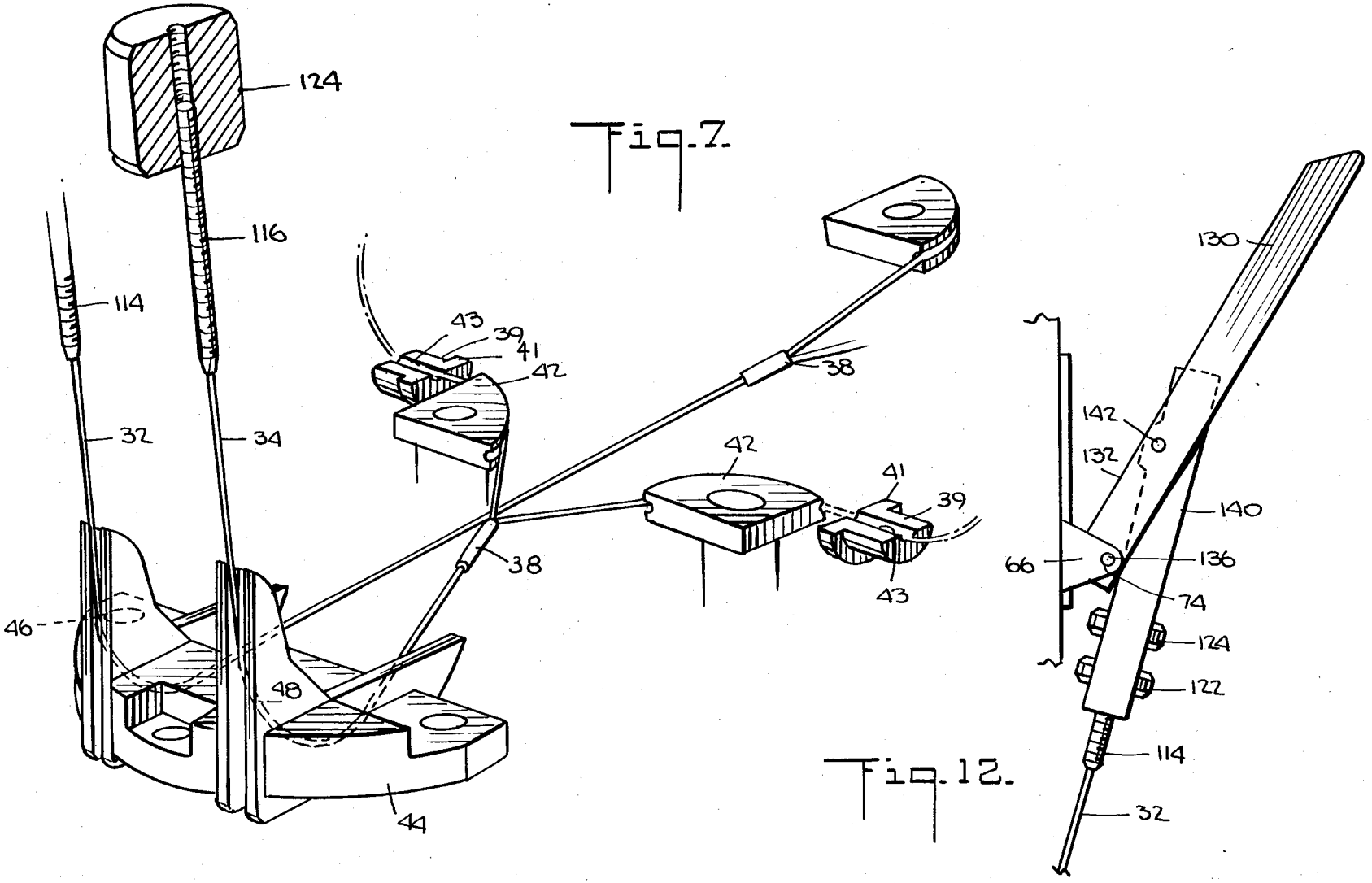
FIG. 7 is a view illustrating the cable plugs and guides.
FIG. 12 is a side view of a single-throw latch suitable for the present invention.
Figure 8:
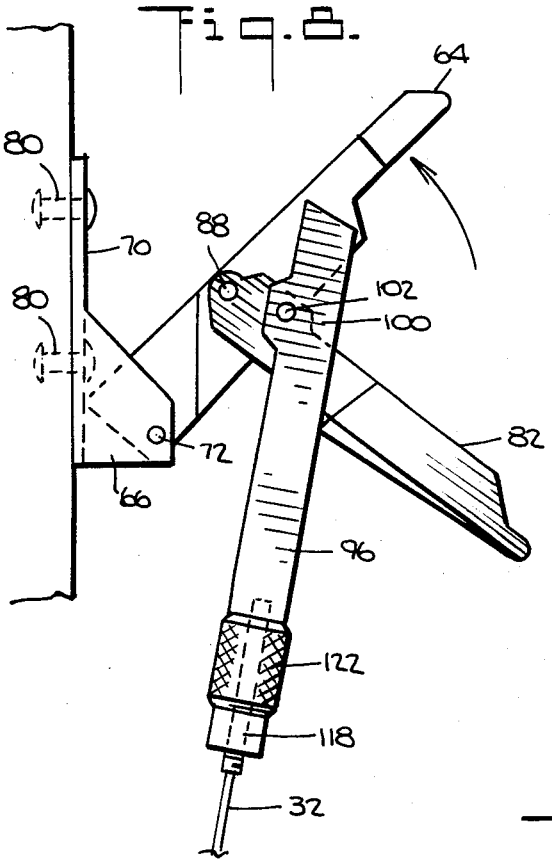
FIG. 8 is a side view of a double throw latch according to the invention illustrating closure of the first lever.

Although cables 32, 34 may be threaded through holes 37 provided in the boot sole 18 to enter cavity 40, it is preferred to provide sealing plugs 39 at the points of entry, as illustrated in FIGS. 4, 5 and 7. Sealing plugs minimize wear upon the boot shell, effect efficient guiding of the cable into and out of the cavity 40 and further serve to ensure water tightness. A preferred plug 39 for use at the points of entry of the cable at the forward portion of the boot is substantially semi-circular with an interior flange 41 and longitudinal indentation 43 having a radius approximately equal to the radius of cables 32, 34. Plugs 39 are accommodated in ports 45 molded in the wall of sole 18 having an upwardly disposed indentation 49 complementary to indentation 43. Indentations 43, 49 form ports 37 through which cables 32, 34 travel. Plugs 39 are preferably constructed of hard plastic. Similarly, sealing plugs are provided for the rear exit ports 52. Such sealing plugs may be similar in construction to plugs 39. However, it is preferred to utilize, as sealing plugs, the channels 46, 48 of guide 44 which are formed to extend into ports 52 provided in the wall of lower shell 16, as shown in FIG. 3.

Figure 6:
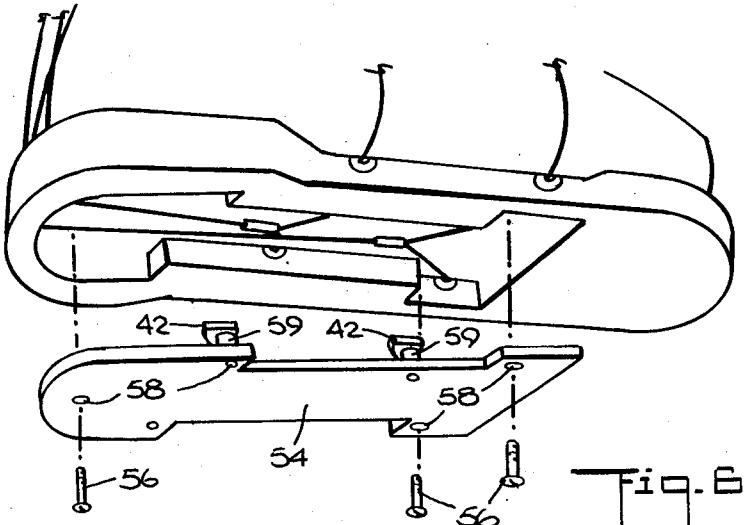
FIG. 6 is an exploded view illustrating the removable sole plate.

To permit assembly of the cables and repair thereof, if required, access to cavity 40 is provided by means of a removable plate 54 on the sole bottom as is illustrated in FIG. 6. Plate 54 is removably secured to sole 18 by means of screws 56 extending through bores 58, annular spacers 59 into receiving bores 60 provided in the upper wall of sole 18 (FIG. 4). Screws 56 are also utilized to secure the quarter-rounds 42 within cavity 40. Instead of a removable sole plate 54, access to cavity 40 may be provided interiorly by a removable foot platform 62 (FIG. 5).

Figure 9:
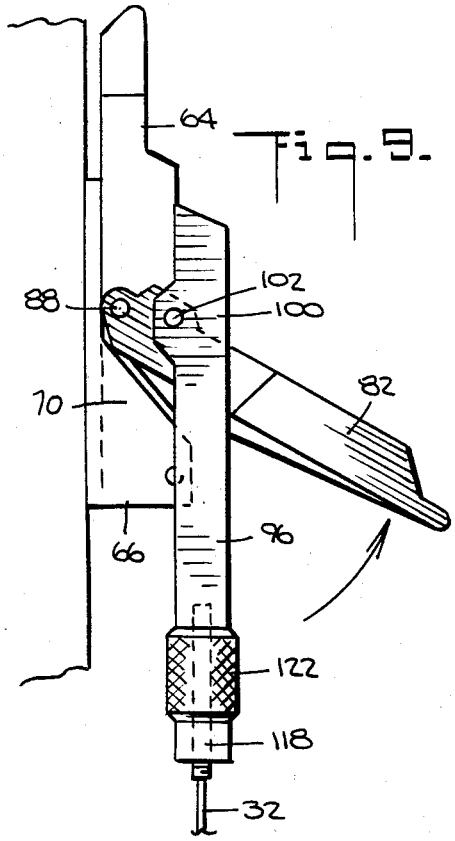
FIG. 9 is side view of the latch of FIG. 8 illustrating closure of the second lever.
Figure 10:
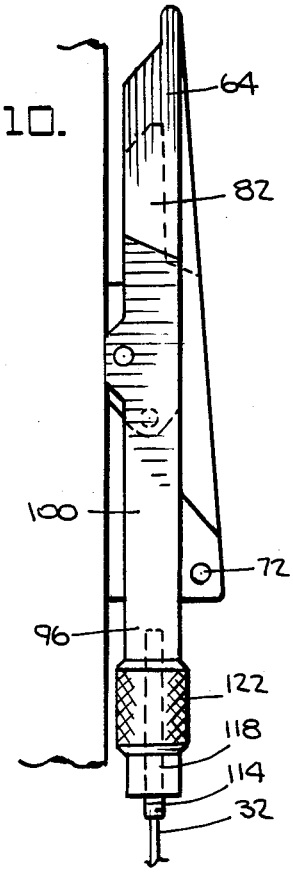
FIG. 10 is a side view of the latch of FIG. 8 in closed position.
Figure 11:
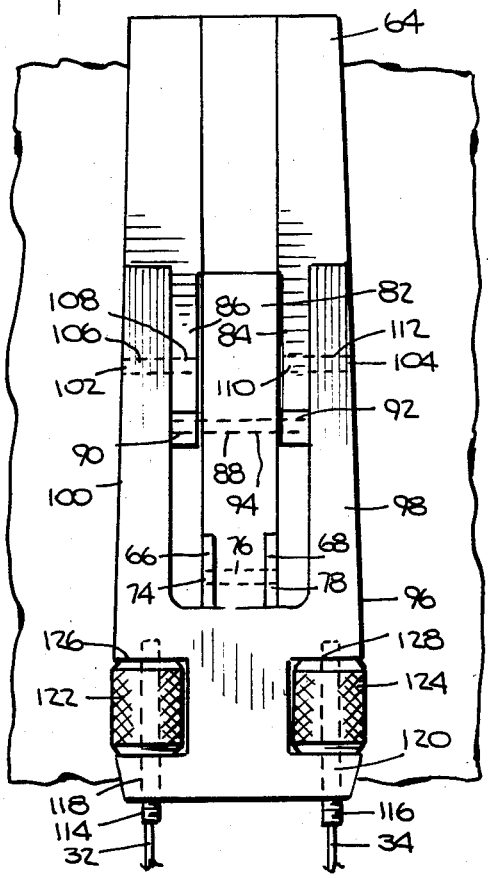
FIG. 11 is an elevational view of the latch of FIG. 8 in closed position.

With reference to FIGS. 8–11, a latch 36 is illustrated which is particularly suited for high performance boots where a high degree of closing force is required to attain the desired fit. Latch 36 comprises a first lever 64 pivotally mounted to upstanding flanges 66, 68 of a stand 70 by a pin 72 extending through bores 74, 76 and 78. Thus, lever 64 pivots about an axis extending through pin 72 generally parallel to stand 70 which, in turn, is secured via rivets 80 to the boot shell at, for example, the rear of upper 12 as shown in FIG. 2. A second lever 82 having a pair of parallel spaced arms 84, 86 is pivotally connected to lever 64 by pin 88 extending through bores 90, 92 and 94 formed at the end of arms 84, 86 and the body of lever 64 respectively. To lever 82, a member 96 having a pair of parallel spaced arms 98 and 100 is pivotally mounted by pins 102, 104 extending through bores 106, 108, 110 and 112 formed in arms 98, 100 and arms 84, 86 of lever 82. Thus, the axes of rotation through pins 88, 102 and 104 are substantially parallel to the axis of rotation through pin 72. The ends of cables 32, 34 are secured to threaded bolts 114, 116 which pass through bores 118, 120 formed in the head of member 96 and are secured to member 96 by knurled nuts 122, 124 housed within recesses 126, 128. When lever 64 is closed, it travels in an arc of about 180°, moving the pivot point of the cable attachment approximately two times the distance of the pivot point to the stand 70. If the pivot point to the stand distance is one inch, closing the lever 64 pulls each cable 32, 34 two inches, resulting in a total draw of cables 32, 34 about the closure flaps 23, 24 (FIG. 1) of four inches. Taking up this four inches of cable travel requires very little force so the mechanical advantage of lever 64 need not be great. As the second lever 82 is closed as shown in FIG. 9, cables 32 and 34 are drawn tighter. Since lever 82 is mounted at or near the pivot point of the first lever 64, lever 82 functions to tighten the shell about the foot after the first lever 64 is closed. Accordingly, the second lever 82 requires more mechanical advantage but a shorter travel space to further tighten the boot. Consequently, the pivot point through pin 88 is selected to require a travel of lever 108 of, for example, $\frac{1}{4}$ to $\frac{3}{8}$ inch, resulting in an additional draw of cables 32, 34 by $\frac{1}{2}$ to $1\frac{1}{2}$ inches which effects further closing of the boot by one to three inches. Thus, latch 36 permits a total play of cables 32, 34 of five to eight inches which is sufficient to allow opening of overlapping flaps 24, 26 for placing the boot on and tightly securing the boot about the wearer's foot. A single lever latch would have to be very long to provide both the large throw required to take up the same degree of cable draw and the high leverage required for tighter boot closing as is desired in high performance boots.

The attachment of the ends of cables 32, 34 to member 96 by bolts 114, 116 threaded into nuts 122, 124 permits fine or microadjustment of cable length to suit individual wearer's needs. Of course, any attachment means may be utilized for connecting cables 32, 34 to member 96.

With reference to FIG. 12, a latch mechanism is illustrated which is suitable for lower performing ski boots where a high degree of tightness is not required. In this embodiment, a single lever 130 having formed at one end thereof a pair of parallel, spaced arms 132, 134 is pivotally mounted to the upstanding flanges 66, 68 of stand 70 by pins 136, 138 extending through accommodating bores 74, 76 in flanges 66, 68 and arms 132, 134 (not shown). Thus, lever 130 pivots about an axis extending through pins 136, 138 generally parallel to the stand 70. A bar 140 is pivotally mounted between arms 132, 134 by pin 142 extending through accommodating bores (not shown) formed in arms 132, 134 and bar 140. The ends of cables 32, 34, as in the previous embodiment, are secured to the end of bar 140 by threaded bolts 114, 116 extending through bores 118, 120 and threaded into knurled nuts 122, 124.

Lever 130 is of such length as to permit draw and loosening of cables 32, 34 to such extent as to permit entry and exit from the boot. As in the previous embodiment, microadjustment of the cable length is accomplished by the knurled nuts 122 and 124 and threaded bolts 114, 116. However, any attachment means may be used for connecting the ends of cables 32, 34 to the bar 140 such as a loop and hook arrangement.

What is claimed is:

1. A closure mechanism for an athletic boot having overlapping closure flaps which comprises: at least one flexible cable arranged exteriorly over said flaps; means directing said cable interiorly of said boot whereby said cable substantially forms a loop encompassing said overlapping flaps; means directing said cable interiorly of said boot to a position remote from said overlapping flaps; means directing said cable exteriorly of said boot at said remote position; and latch means connected to at least one end of said cable, said latch means being secured to the exterior of said boot and adapted to pull said cable to draw said loop and flaps closed.

2. The closure mechanism according to claim 1 wherein said means directing said cable interiorly of said boot and said means directing said cable exteriorly of said boot are ports formed in the walls of said boot.

3. The closure mechanism according to claim 1 wherein said latch means comprises a lever having a pair of parallel spaced arms each pivotally connected for rotation about a common axis to a stand mounted to the wall of said boot; a bar having one end pivotally connected between said arms; and means connecting the other end of said bar to said cable end.

4. The closure mechanism according to claim 3 wherein said means connecting said bar to said cable ends comprises a bolt secured to the end of said cable adapted to pass through a bore formed in the end of said bar and threaded into a nut rotatably housed within said bar.

5. In an athletic boot having a synthetic molded shell comprising a sole and an upper foot encasing portion, said foot encasing portion including a pair of overlapping flaps at the front for entry and exit from the boot, an improved closure mechanism for closing and securing said overlapping flaps about the foot which comprises: at least one tensilely strong, flexible cable arranged to overlap said flaps and enter opposite sides of said sole; means joining said cable interiorly of said sole whereby said cable substantially forms a loop encompassing said overlapping flaps; said joined cable extending rearwardly interiorly of said sole; guide means arranged to direct said cable to exit said shell at the rear of said boot above said sole; latch means mounted to the rear of said shell; and means connecting said cable to said latch means, said latch means being adapted to pull said cable to close the loop and said overlapping flaps.

6. The improved closure mechanism according to claim 5 wherein said cable joining means is a clamp which secures one end of said cable to itself.

7. The improved closure mechanism according to claim 5 wherein said guide means for directing said cable to exit said shell is a curved channel-shaped guide secured within said sole, said channel being formed to guide said cable upwardly to exit ports formed in said shell.

8. The improved closure mechanism according to claim 5 wherein said latch means comprises a lever having a pair of parallel spaced arms, each pivotally connected for rotation about a common axis to a stand mounted to said shell; a bar having one end pivotally connected between said arms; and means connecting the other end of said bar to the end of said cable whereby rotation of said lever pulls said cable to close said loop and flaps.

9. The improved closure mechanism according to claim 8 wherein said means connecting said bar to said cable comprises a nut rotatably housed in said bar; a bore formed in the end of said bar; and a threaded bolt secured to the end of said cable, said bolt passing through said bore and being threaded to said nut.

10. A ski boot comprising a synthetic molded shell having a sole and an upper foot encasing portion enclosing a padded inner boot and tongue; a pair of frontal overlapping closure flaps formed in said upper foot encasing portion at the area of said tongue for foot entry and exit; at least one tensiley strong; flexible cable arranged to overlap said closure flaps and enter opposite sides of said sole, said sole defining an internal longitudinal cavity; means directing said cable rearwardly within said cavity; means joining said cable within said cavity whereby said cable substantially forms a loop encompassing said overlapping closure flaps; guide means arranged at the rear of said cavity and adapted to direct said cable to exit said shell at the rear of said boot above said sole portion; and latch means mounted to said shell at the rear of said upper foot encasing portion, said latch means having at least one lever engaging the end of said cable and arranged to pull said cable to close said loop and overlapping closure flaps.

11. The ski boot according to claim 10 wherein said means directing said cable rearwardly within said cavity comprises quarter-rounds mounted within said cavity adjacent the points of entry of said cable to said cavity.

12. The ski boot according to claim 10 wherein said cable joining means is a clamp which secures one end of said cable to itself.

13. The ski boot according to claim 10 wherein said guide means comprises a unit molded within said sole defining a curved upwardly directed channel adapted to direct said cable through a port formed within said shell above said sole.

14. The ski boot according to claim 10 wherein said sole includes a removable bottom plate providing access to said cavity.

15. The ski boot according to claim 10 wherein said latch means comprises a lever having a pair of parallel spaced arms each pivotally connected for rotation about a common axis to a stand mounted to said shell; a bar having one end pivotally connected between said arms; and means connecting the other end of said bar to the end of said cable whereby rotation of said lever pulls said cable to close said loop and overlapping flaps.

16. The ski boot according to claim 15 wherein said means connecting said bar to said cable comprises a nut rotatably housed in said bar; a bore formed in the end of said bar; and a threaded bolt secured to the end of said cable, said bolt passing through said bore and being threaded to said nut.

17. The ski boot according to claim 10 wherein said latch means comprises a first lever pivotally connected to a stand mounted to said shell; a second lever having a pair of spaced parallel arms pivotally connected to said first lever for rotation about an axis parallel to the axis of rotation of said first lever; a third member having a pair of spaced parallel arms pivotally connected to said second lever for rotation about an axis parallel to the axes of rotation of said first and second levers; and means connecting the end of said cable to the head of said third member.

18. The ski boot according to claim 17 wherein said means connecting the end of said cable to the head of said third member comprises a nut rotatably housed within said head, a bore formed within said head; and a threaded bolt secured to the end of said cable, said bolt passing through said bore and being threaded to said bolt.

19. In a closure mechanism for closing overlapping flaps of an athletic boot comprising a member adapted to close said flaps by actuation of a latch, an improved latch, which comprises: a first lever pivotally connected to a stand adapted for mounting to said boot; a second lever having a pair of spaced parallel arms pivotally connected to said first lever for rotation about an axis parallel to the axis of rotation of said first lever; a third member having a pair of spaced parallel arms pivotally connected to said second lever for rotation about an axis parallel to the axes of rotation of said first and second levers; and means connecting said third member to said closure member for closing said overlapping flaps upon rotation of said first and second levers.

* * * * *